US008640269B2

(12) United States Patent
Davenport et al.

(10) Patent No.: US 8,640,269 B2
(45) Date of Patent: Feb. 4, 2014

(54) SANITARY WATER CONSERVATION DEVICE

(75) Inventors: Quintin Davenport, Tolmans Hill (AU); David Fisher, Sandy Bay (AU)

(73) Assignee: Ducane Research and Development Pty Ltd, Sandy Bay, Tasmania (AU)

( * ) Notice: Subject to any disclaimer, the term of this patent is extended or adjusted under 35 U.S.C. 154(b) by 222 days.

(21) Appl. No.: 12/514,265

(22) PCT Filed: Nov. 28, 2007

(86) PCT No.: PCT/AU2007/001838

§ 371 (c)(1),
(2), (4) Date: May 8, 2009

(87) PCT Pub. No.: WO2008/064420

PCT Pub. Date: Jun. 5, 2008

(65) Prior Publication Data

US 2010/0032032 A1 Feb. 11, 2010

(30) Foreign Application Priority Data

Nov. 30, 2006 (AU) ..... 2006906729

(51) Int. Cl.

| | |
|---|---|
| ***E03D 1/00*** | (2006.01) |
| ***E03D 3/00*** | (2006.01) |
| ***E03D 5/00*** | (2006.01) |
| ***E03D 11/10*** | (2006.01) |
| ***A47K 4/00*** | (2006.01) |
| ***E03C 1/01*** | (2006.01) |
| ***B67D 7/84*** | (2010.01) |

(52) U.S. Cl.
USPC ..... 4/300; 4/438; 4/441; 4/665; 222/165

(58) Field of Classification Search
USPC ..... 4/438–442, 665, 300; 222/164–166, 222/160
See application file for complete search history.

(56) References Cited

U.S. PATENT DOCUMENTS

| | | | |
|---|---|---|---|
| 284,976 | A | 9/1883 | Parfitt |
| 645,751 | A | 3/1900 | Lewis |

(Continued)

FOREIGN PATENT DOCUMENTS

| | | | |
|---|---|---|---|
| CH | 590980 | A5 | 8/1977 |
| DE | 3610737 | A1 | 10/1987 |
| WO | 01/02656 | A1 | 1/2001 |

*Primary Examiner* — Len Tran
*Assistant Examiner* — Chee-Chong Lee
(74) *Attorney, Agent, or Firm* — Richard M. Goldberg

(57) ABSTRACT

An installation for the intermediate holding and storage of sewage and effluent, said installation comprising a sealable housing 9 having an inlet 1 for receiving said effluent and an outlet for discharging said effluent, a holding reservoir 2 pivotally mounted and positioned within said housing to receive and temporarily store a quantity of said effluent, wherein said holding reservoir is an asymmetrically shaped open bucket adapted to automatically move about said pivot from a first position adapted for receiving and storing said effluent to a second invented position where stored effluent is emptied into said housing under the influence of gravity once the accumulated effluent reaches a sufficient mass wherein said housing includes an effluent race 11 incorporated into the floor of said housing to divert said effluent directly to said outlet.

13 Claims, 6 Drawing Sheets

(56) References Cited

U.S. PATENT DOCUMENTS

| | | | | | |
|---|---|---|---|---|---|
| 763,246 | A | * | 6/1904 | Bender et al. | 4/343 |
| 965,400 | A | * | 7/1910 | McPherson | 4/321 |
| 1,256,320 | A | * | 2/1918 | Holmes | 4/321 |
| 1,543,311 | A | * | 6/1925 | Anderson | 4/439 |
| 3,536,196 | A | * | 10/1970 | Zeff et al. | 210/97 |
| 3,843,976 | A | * | 10/1974 | Miya et al. | 4/300 |
| 3,885,254 | A | * | 5/1975 | West | 4/111.3 |
| 2006/0254352 | A1 | | 11/2006 | Nivens, Jr. et al. | |

* cited by examiner

SANITARY WATER CONSERVATION DEVICE

CROSS-REFERENCE TO RELATED APPLICATIONS

The present application claims priority from Australian Provisional Patent Application No 2006906729 filed on 30 Nov. 2006, the content of which is incorporated herein by reference.

INTRODUCTION TO THE INVENTION

This invention relates to water conservation and water measured dosing or liquid dosing, and in particular, to an installation for reducing the quantity of water used to flush a toilet.

The unit has at least 3 distinct uses.

1. For reducing the quantity of water used to flush a toilet by supplementing the waste water from the toilet for the sewer pipe drainage leg of the transport path with an additional amount from other household water fixtures. IE 1 liter of toilet waste water with say 8 liters from other water fixtures.
2. For providing a measured dosing unit for gray water reuse in the garden for irrigation.
3. For irrigation purposes with fresh potable water as noted in 2.

BACKGROUND TO THE INVENTION

Instance 1

The sanitary flushing of toilets and other waste disposal sanitary fittings involves the use of a sufficient quantity of water at each flush to ensure the contents of the toilet is removed from the bowl completely and transferred to a sewer pipe with sufficient flow to ensure the contents of each flush migrates through the sewer pipes without clogging up.

Historically, toilet flush systems have been designed to provide an adequate flush volume of a toilet to accommodate the removal and movement of stools and solids. This volume of water is often in excess of requirements, particularly where no solids are present.

The amount of water used for the purpose of toilet flushing represents a significant portion of domestic water use.

It would be desirable to reduce the quantity of water required at each flush whilst maintaining sufficient flow through the sewer pipes to avoid clogging.

Instance 2 & 3

The use of the installation as an irrigation means allows for a measured dose equal to the volume of the bucket to be delivered at one time. The dosing method allows for a pipe to be connected with a specified number of outlets to the ground. The tipping bucket delivers a measured amount which is then divided to the number of soakage spikes provided to the gravity fed pipe. This use of the installation of the invention can either use fresh water or be connected to household gray water lines.

Statement of the Invention

In a first aspect the invention provides an installation for the intermediate holding and storage of liquid, said installation comprising a housing having an inlet for receiving said liquid and an outlet for discharging said liquid, a holding reservoir pivotally mounted and positioned within said housing to receive and temporarily store a quantity of said liquid, wherein said holding reservoir is an asymmetrically shaped open bucket adapted to automatically move about said pivot from a first position adapted for receiving and storing said liquid to a second inverted position where stored liquid is emptied into said housing under the influence of gravity once the accumulated liquid reaches a sufficient mass wherein said housing includes a liquid race incorporated into the floor of said housing to divert said liquid directly to said outlet.

The liquid may be sewage and effluent.

The holding reservoir may comprise a bucket with a release mechanism for emptying said bucket when sufficient quantity of sewage is accumulated. The bucket may be bias to automatically return to the first position by counterweight action. The holding bucket may be pivoted about an axis and provided with an asymmetric storage capacity either side of said pivot such that once a sufficient quantity of sewage is accumulated in the bucket, the bucket will rotate under gravity and empty the contents therein to said outlet.

The holding bucket preferably includes a spout positioned on a first side for directing the contents of said bucket to said outlet. The bucket may be shaped in cross-section to include a partial circle portion and a tapering spout extending therefrom.

The bucket may be pivotally fitted within said housing on bearings or on a set of open bearings and include a stop to ensure the bucket only rotates in one direction to empty the contents via said spout.

The holding bucket preferably includes a contoured lip associated with the spout configured to divert the effluent toward the race outlet. The interior of the reservoir or holding bucket is preferably smoothly contoured to avoid accumulation or trapping of waste materials.

The unladen reservoir or bucket preferably has a centroid of plane area and mass moment of inertia to the right or far side of said pivot point in relation to said spout.

The laden reservoir or bucket preferably has a mass moment of inertia which progressively moves during filling from the right or far side of said pivot relative to said spout to the left or near side of said pivot relative to said spout, thereby causing the reservoir to rotate to the second position.

The reservoir or bucket preferably includes two counterweights to assist in the automatic return of the reservoir once emptied to the first position, said counterweights including a first position counterweight positioned of the farthest distance from the pivot point centroid when in said first position and the second position counterweight positioned at the farthest distance from the pivot point centroid when in said second position.

The housing of the installation may include an inspection opening on the top end thereof and an integral lid fitting to said opening whereby the integral lid includes a support bracket and pivot points for said reservoir.

The invention will now be described with reference to one particular embodiment shown in the figures.

LEGEND

Figure 1:
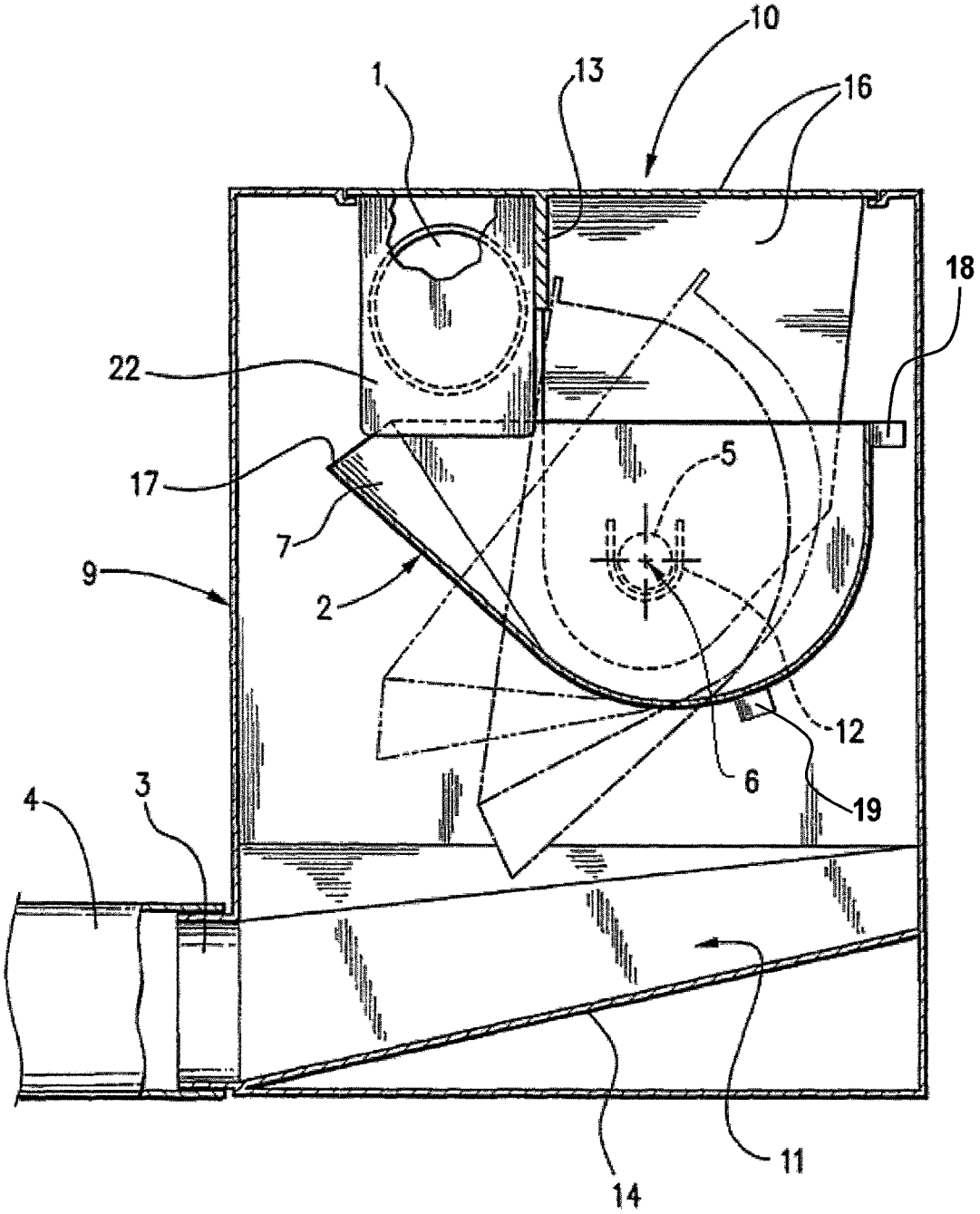
FIG. 1 shows a cross-section side view of the installation.

1. Inlet
2. Holding reservoir
3. Outlet
4. Sewer pipe
5. Pivot
6. Axis
7. Spout
8. First side
9. Housing
10. Access (inspection cover)
11. Race
12. Bearing surface (open bearing)
13. Stop
14. Floor/base
15. Sides
16. Lid/bracket
17. Lip
18. First position counterweight
19. Second position counterweight
20. Solid deposit
21. Fluid deposit
22. Baffle Referring to the figures, the invention will be described with reference to one particularly preferred embodiment where the installation of the invention is adapted for fitting and incorporation into the toilet flushing system of a domestic house. The installation of the invention can of course be adapted to a wide range of sanitary waste disposal situations and can make good use of water flow and flushing facilities available from gray water and other services available in a typical domestic situation.

Referring particularly to the primary embodiment, the invention provides an installation or system adapted for the intermediate and temporary holding or storage of small or intermediate quantities of sewage and effluent; in particular, where the solid matter included within the sewage and effluent would or may be insufficient to ensure efficient flow and movement of a small or reduced quantity of sewage and effluent through the sewage piping and plumbing facilities into the main sewer network.

The installation shown in FIG. 1 includes a generic housing 9 for holding and mounting the various components of the installation. The housing includes an inlet 1 positioned at either or both sides of the upper portion of the housing. The inlet is adapted to receive the outlet from a toilet or other sanitary fitting which is directed into the installation of the invention by way of the standard or routine plumbing accompanying a toilet or other sanitary facility.

The installation of the invention further includes a holding reservoir 2 which is particularly adapted to contain the sewage or effluent flushed through the inlet or inlets 1. The holding reservoir is positioned underneath the inlet 1 and has a volumetric capacity for storing sufficient effluent, including liquid, to ensure that the transfer of the contents of the reservoir from the installation of the invention into the sewer piping system of a domestic house or other situation, is sufficient to adequately transfer sewage and effluent, including solid materials, through the piping system without a risk of clogging or blockage.

The installation of the invention further includes an outlet 3 for conducting the effluent or sewage once emptied from the holding reservoir 2.

The holding reservoir preferably takes the form of a bucket or other container adapted to receive intermediate deliveries of sewage or effluent and store the intermediate deliveries so as to build up a critical or minimum volume of liquid necessary to ensure the efficient flushing or delivery thereof into the sewer system.

Figure 6:
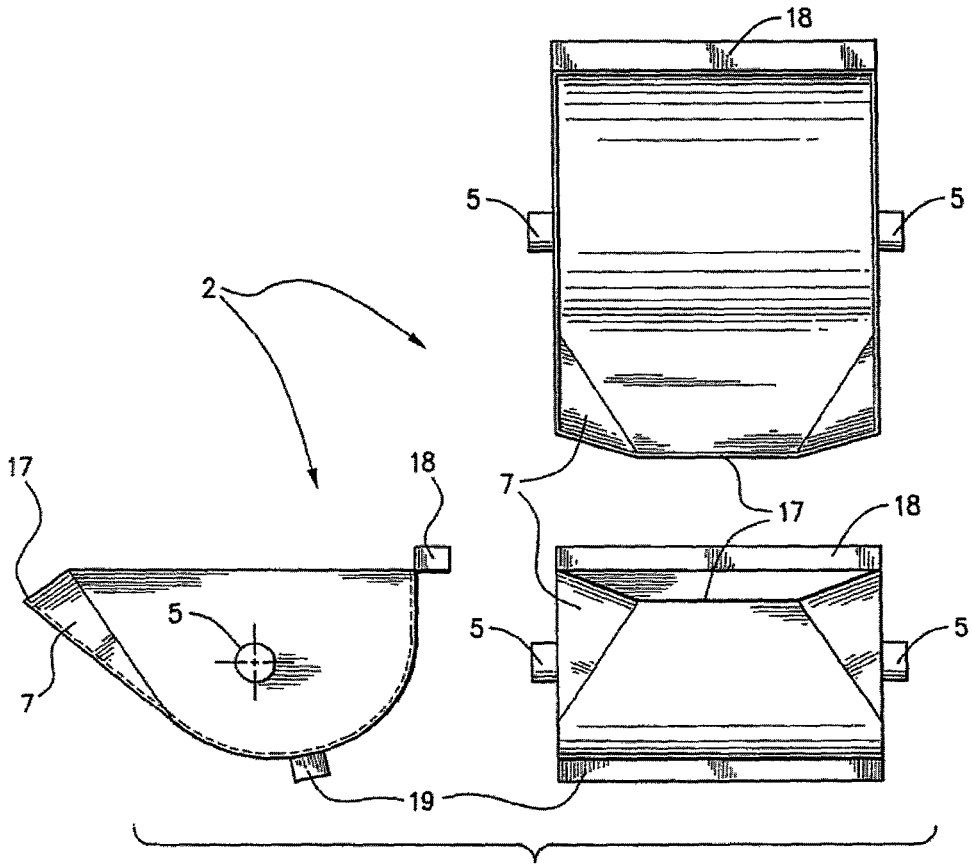
FIG. 6 shows side, top and front views of the reservoir.
Figure 7:
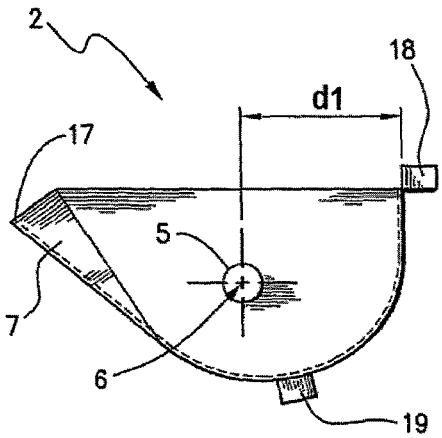
FIG. 7 shows a side view of the reservoir in the first position.

In the one particularly preferred embodiment of the invention shown in FIGS. 6 and 7, the holding reservoir 2 takes the form of a pivotally rotatable, asymmetrically shaped, bucket which is pivoted around pivot points 5 for rotation about an axis 6. The asymmetric shape of the holding reservoir 2 is clearly detailed in FIGS. 6 and 7 where 25 the shape of the bucket is generically formed with the bulk of the reservoir taking the shape of a cut-off of a portion of a full circle with a pouring spout 7 attached as an extension thereof. The shape of the partial full circle is economic in cross-sectional area and allows the unit to be enclosed in a small encasement or housing 9. In addition, the rounded shape of the main portion of the reservoir ensures minimal edges and 30 regions for adherence of waste and allows for a smooth and continuous surface on the inside of the reservoir.

The spout 7 of the bucket includes a contoured lip 17. The contoured lip ensures that the waste exits the tipping reservoir as it moves from position 1 to position 2 such that the exiting waste is concentrated at the exit sewer pipe and the pulse flush provided by the movement of the reservoir from the first to the second position and imparts a velocity to the expelled waste equal to the gravitational fall of the fluid. The configuration of the spout and contoured lip ensures a concentration of fluid and waste flow towards the lowest point of the housing 9.

The holding reservoir 2 has a tipping pivot point 5 which balances the unladen centroid of the reservoir and the laden weight of the reservoir plus accumulated waste. The pivot point 5 is positioned to ensure that the reservoir only tips when the waste water reaches the desired level. The pivot point is likewise on a vertical axis placed to ensure that once the reservoir tips the waste material in the bucket is completely evacuated prior to the bucket resetting to the first position. The unladen reservoir position as shown in FIG. 6 has a centroid of plane area 23*a* (FIG. 9) and mass moment of inertia to the right or rear side 23 (FIG. 9) of the pivot point as displayed and indicated in FIG. 6, being removed from the position of the spout. Once the reservoir becomes laden, the mass moment of inertia progressively moves from the right of the pivot point as shown in FIG. 6 to the left or front side 24 (FIG. 9) of the pivot point as shown in FIG. 7 thereby causing the reservoir to rotate from the first to the second position and evacuate the reservoir.

Figure 8:
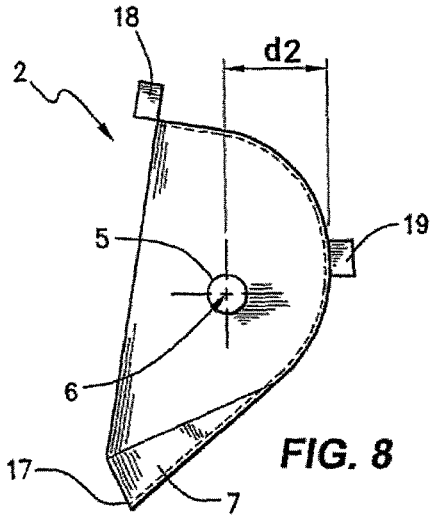
FIG. 8 shows a side view of the reservoir in the second position.

In order to assist the reservoir to return from the second position (FIG. 8) to the first position (FIG. 7), the reservoir is provided with counterweights. To overcome the inertia of the reservoir 2 to stay in the second position, the counterweight must be positioned such as to apply a moment about the pivot point 5 to counter the weight of the empty reservoir 2 in the second position (FIG. 8). A first position counterweight 18 can be seen in FIG. 7, where its position is at a farthest distance "d1" from the pivot point centroid as measured in a horizontal direction when the reservoir 2 is in the first position and on the opposing side of the reservoir 2 from the spout 7. The second position counterweight 19 is clearly shown in FIG. 8 being positioned at a farthest distance "d2" from the pivot point centroid as measured in a horizontal direction, when the bucket is in the second position.

The asymmetric shape and free pivotal mounting of the holding reservoir 2 allows the bucket to accumulate effluent or sewage and once a critical volume is reached within the bucket the biasing provided by the asymmetric shape of the bucket either side of the pivot point 5 causes the bucket to invert or tip spontaneously, thereby disgorging and releasing the whole contents of the bucket into the bottom of the housing 9 for disposal through the outlet 3 into a sewer pipe 4.

The bucket may be pivoted in an open bearing or bearing surface 12 which allow ready removal of the bucket from the housing for securing etc.

Figure 4:
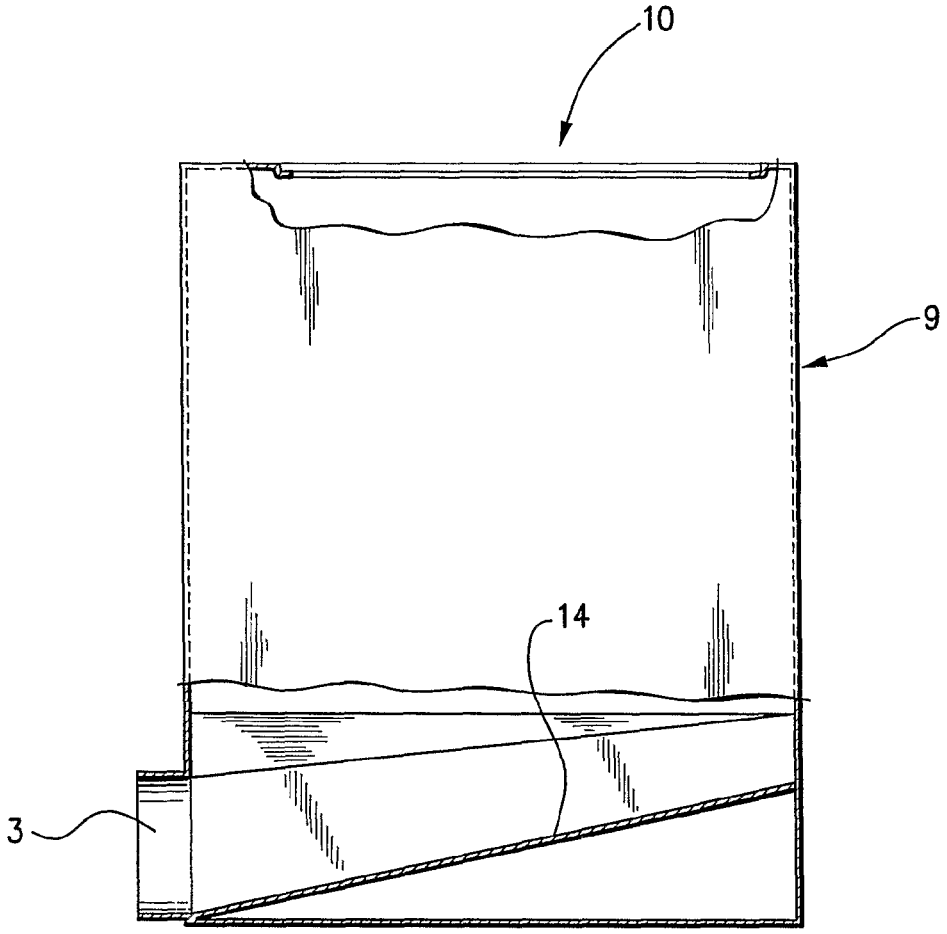
FIG. 4 shows a side view of the installation housing detailing the floor or base angle of the race.
Figure 5:
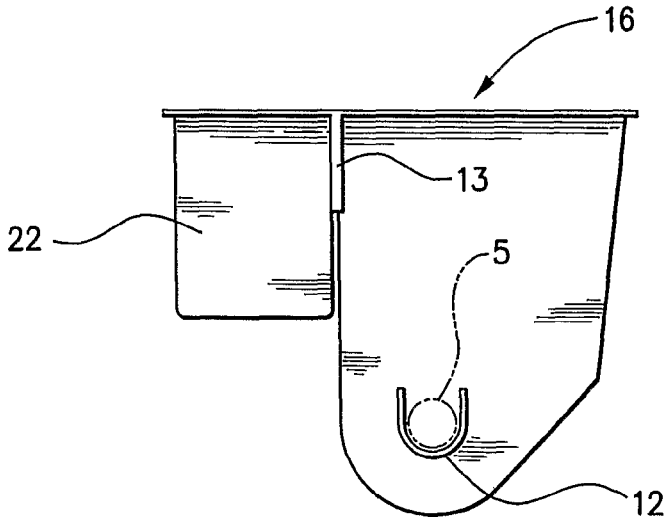
FIG. 5 shows a side view of the integral lid and support bracket including pivot points for the reservoir.

In order to facilitate the reliable and correct asymmetric action of the holding reservoir 2, the housing is provided with an integral lid and support bracket 16 as shown in FIG. 5. The lid and support bracket are designed to fit in an access point 10 as shown in FIG. 4 of the housing 9. The bracket is provided with a pivot point 5 for suspension of the reservoir and is also provided with the stop 13 to prevent the holding reservoir from moving too far from the first to the second position. In addition, the stop 13 is adapted to ensure the bucket only empties in one direction about the pivot point 5, thereby ensuring that the intermittent supply of effluent or sewage to the bucket, does not cause instability or movement of the bucket away from the spout 7 being the preferred side for delivery of the contents. The stop is preferably positioned at the rear of the bucket as shown in FIG. 1. The bracket is also fitted with a central baffle 22 to separate the two inlets 1 of the housing to prevent input to the device passing directly from one inlet to the other.

Figure 2:
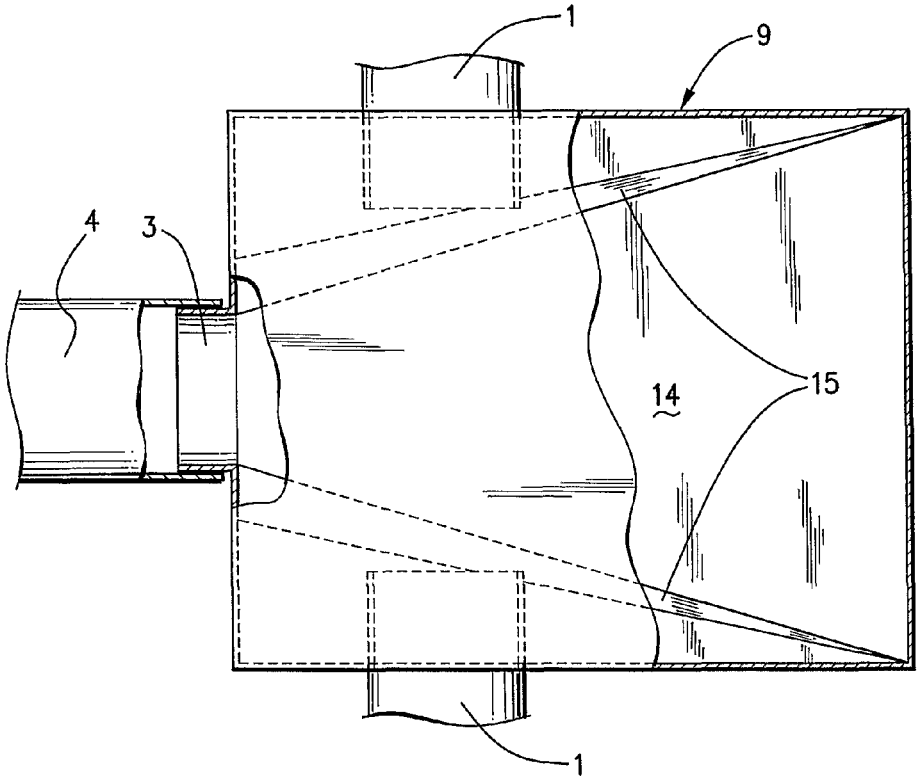
FIG. 2 shows a plan view of the installation with the bucket removed.
Figure 3:
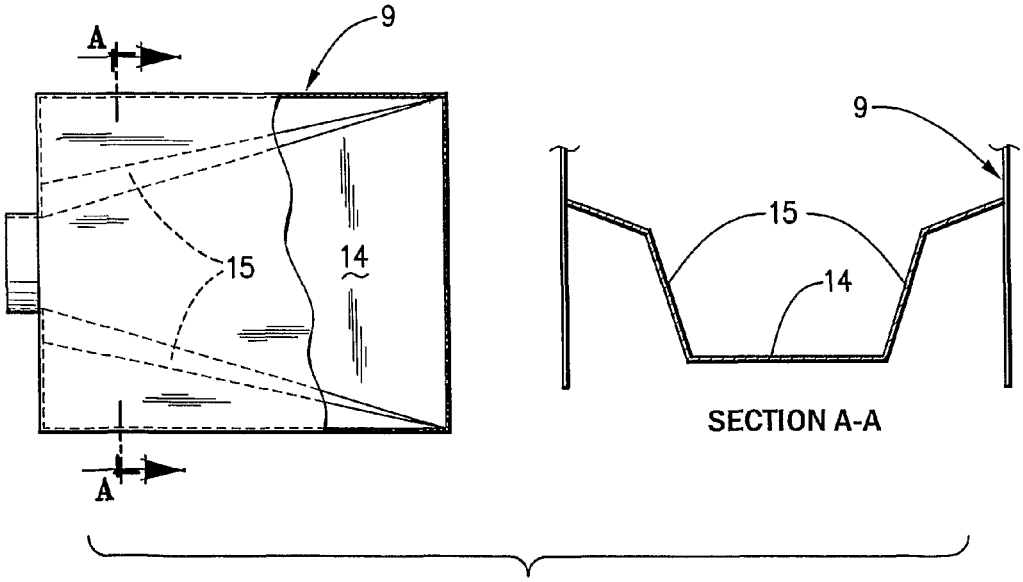
FIG. 3 shows a plan view of the installation with the bucket removed including a section through the race Section A-A.

In addition, the housing 9 may be provided with the tapered race 11 which can be seen in plan view from FIGS. 2 and 3 and side view in FIG. 4. The tapered race ensures the efficient delivery of the contents of the bucket into the outlet 3 and sewer pipe 4 with the slope and tapering of the tapered race ensuring maximum inertia is provided by the dumping of the contents of the holding bucket once the critical volume is reached.

The configuration of the tapered race includes a floor region or base 14 positioned towards the bottom of the housing 9. The slope provided for the floor or base of the tapered race ensures that effluent dumped from the rotating reservoir is rapidly transmitted down the tapered race into the outlet 3. In addition, the tapered race includes tapered sides 15 which work in concert with the sloped face 14 to ensure that all effluent and wastage is efficiently and precisely directed to the outlet minimising any spaces where sewerage or effluent could accumulate. Specifically, side walls 15 taper in a side to side direction so that the distance between the side walls reduces toward the outlet of the race, as shown in the left figure of FIG. 3.

In addition to the provision of a tapered race, the interior of the reservoir is smoothly contoured to likewise eliminate any spaces that could trap sewerage or debris such that the smooth contouring of the interior of the reservoir extending to the spout region 7 ensures an efficient and complete movement of all accumulated waste from the reservoir during the tipping and emptying action. The combination of the positioning of the reservoir and the smooth delivery of contents through the spout onto the tapered and configured race ensures a smooth, splash-free and hygienic delivery of the contents of the reservoir to the outlet 3 of the housing.

The installation of the invention may include an inspection cover or access point 10 provided for the housing, preferably on the top thereof to allow ready inspection and maintenance, if necessary. The inspection cover and access 10 most preferably allows for complete sealing of the housing and installation of the invention to ensure adequate and hygienic quarantining of the temporarily stored sewage or effluent from the general environment.

The installation of the invention can be fitted or retrofitted to existing sewage systems by incorporation between the toilet outlet and the sewer pipe 4. In this manner, the installation of the invention can be buried in-ground or attached adjacent the toilet or other sanitary waste fitting to which it is applied. The positioning of the inlet 1 and outlet 3 of the installation of the invention are preferably configured to align with the preferred orientation of plumbing known and provided in standard plumbing incorporation. Such configurations of the installation of the invention allow ready retrofitting of the installation to existing domestic situations and allow for use to the installation of the invention readily and easily in new building constructions.

In use, the installation of the invention can be readily retrofitted or incorporated in new constructions and is specifically designed to allow the amount of water used for flushing toilets and other sanitary installations to be reduced to an absolute minimum for clearing the soiled water including effluent and sewage past the toilet bowl and "p" or "s" trap or any odour barrier and into the installation of the invention. As the amount of water used will be reduced to an absolute minimum, in most cases the flush will not be sufficient to adequately traverse the sewer piping and exterior plumbing of a house or other situation. However, such a reduced flush will be sufficient to allow the movement of soiled water and waste from the toilet or other sanitary fitting into the installation of the invention and out of the immediate environment of the user. The installation of the invention is particularly adapted to accumulate and temporarily store a number of such minimal water usage flushes whereby the gradual accumulation of volume into the holding bucket allows the installation to accumulate, within the reservoir, sufficient volume to allow safe and efficient entry of the accumulated waste into the sewer pipe and septic systems.

Whilst the holding reservoir could adopt a wide range of configurations and permutations, including a wide range of release mechanisms and systems; the particularly preferred embodiment, as detailed in the current application, provides for a highly simplified, gravity operated, passive system where the asymmetric shape of the holding bucket and the positioning of the pivot 5 allowing for the completely passive activation of the bucket, In this manner, the holding bucket securely receives the required number of flushes or inputs in a stable manner. However, once the crucial volume or weight is achieved, the bucket moves from its resting position to immediately adopt an over-centre tilt driven by gravity such that the whole contents of the bucket are immediately and forcefully dispatched into the bottom of the housing 9 down the tapered race 11 and into the sewer pipe 4. In this manner, the accumulation of a plurality of flushes from the toilet outlet are accumulated and only discharged from the installation of the invention upon achieving a critical mass; that allows for safe, efficient and sanitary delivery of effluent and sewage down a sewer pipe system with minimised chance or incidents of blockage.

Figure 9:
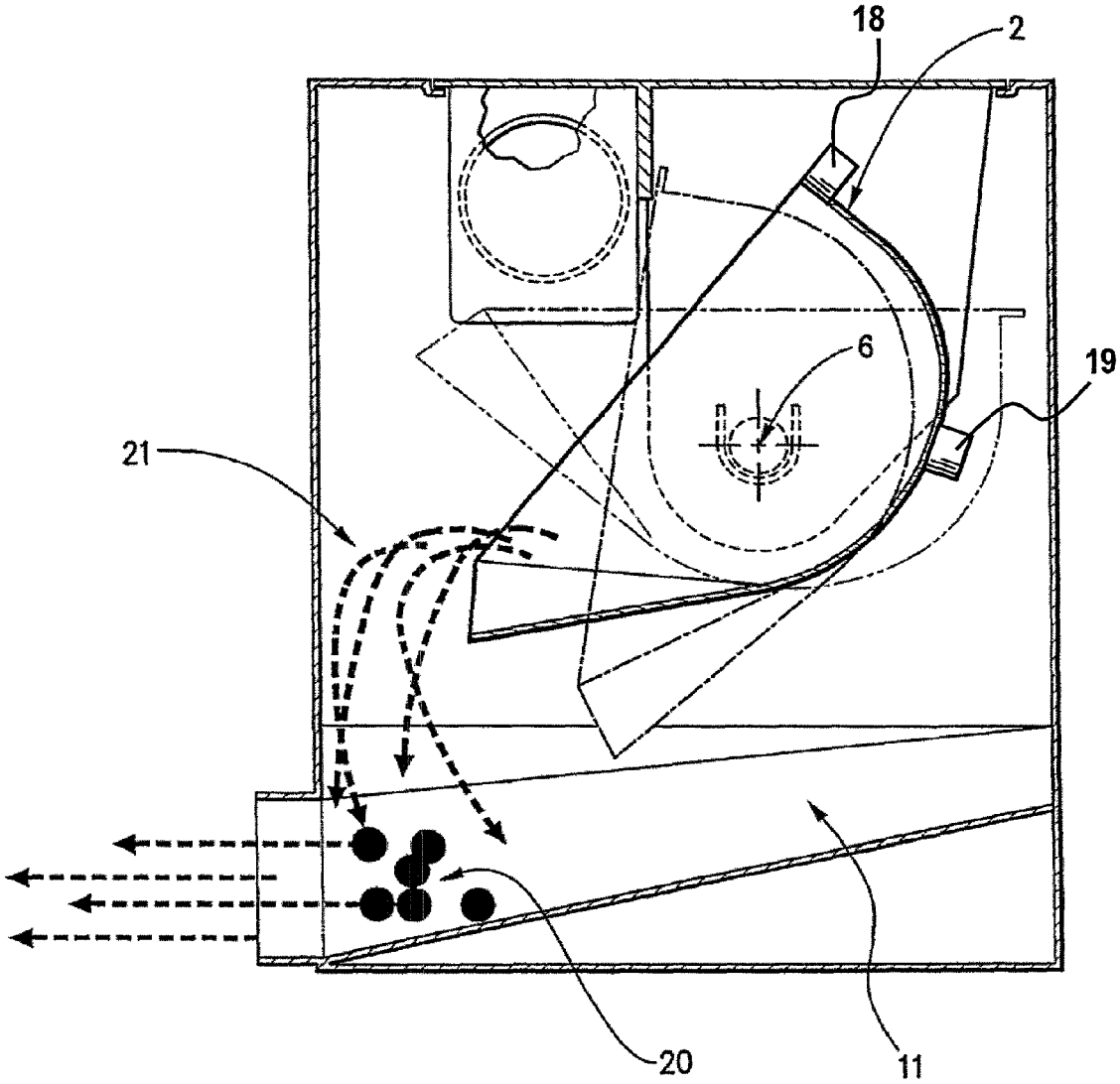
FIG. 9 shows the flow characteristics of the installation in a first stage of deposition.
Figure 10:
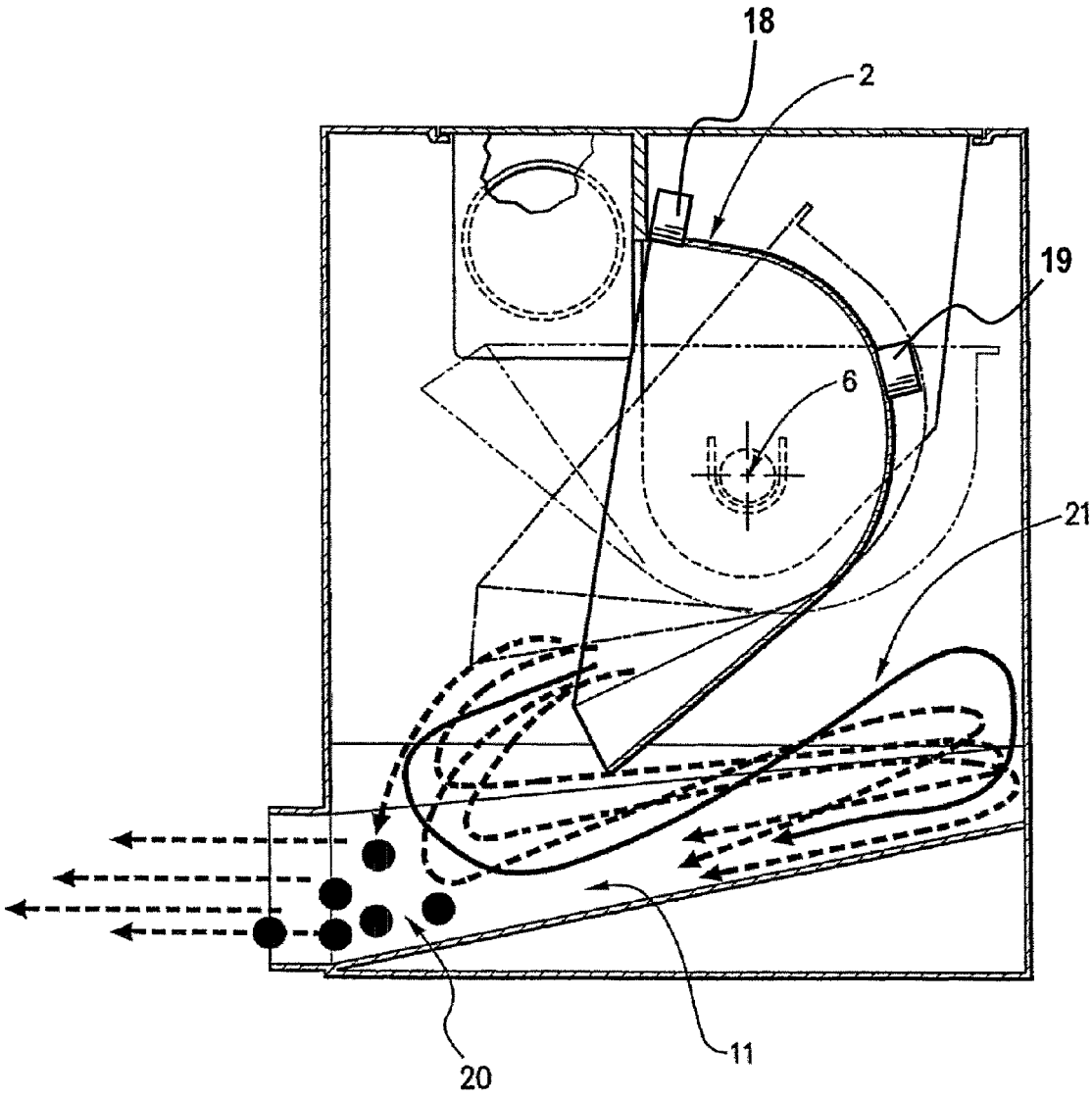
FIG. 10 shows the flow characteristics of the installation at a second stage of deposition.

The fluid flow characteristics and advantages of the specific configuration of the housing enclosure and race configuration are shown with reference to FIGS. 9 and 10. Referring firstly to FIG. 9, a first stage of action is shown with the combination of the holding reservoir 2 and the tapered race 11 providing a two-part flow velocity to the waste material. The waste material after leaving the reservoir passes to the lowest point of the enclosure with some solid material 20 tending to exit directly to the sewer line. The remainder of the waste material, in particular the fluids 21, tend to be forced up the tapered floor toward the rear of the housing and return by gravity to exit the housing as part of the first flow. Referring to FIG. 10, the second stage action shows that the fluid characteristics of the waste materials are also governed by the velocity imparted by the installation and the action of the tipping reservoir. This action is predicted in Bernoulli's equation $P+\frac{1}{2}pv^2+pgh=\text{constant}$ where P is the pressure p is the density v is velocity h is elevation; and g is gravitational acceleration and is a static head which is the actual elevation of the fluid above the reference level. The reference level for the invention is the base invert of the outlet pipe 3. This static head does not exist at a specific location in a sewer network because the grades are substantially consistent. The unique feature of the enclosure of the invention includes the concentration of a static head which allows the fluid 21 to be given a velocity sufficient to carry the waste water and materials through at least 30 meters of sewer pipe at 1.65% for 100 mm diameter.

The motion and passive activation of the holding bucket of the invention could of course, be provided in a wide range of alternative active forms including electronic, electric, solenoid, valve, vacuum or alternative mechanical discharging systems and all of these embodiments are included within the scope of the current invention.

The compact and serviceable nature of the installation of the invention makes a readily adaptable for in-ground fitting. Alternatively, the installation can be ready adapted for fitting to the exterior wall of a house or other domestic situation at a first floor, second floor or subsequent elevation.

The installation of the invention is primarily adapted to utilize the normal water flows of a reduced flush toilet system; but, can also be modified to utilize gray water availability and can be configured to service public amenities, offices, workshops, factories etc.

The installation of the invention can include suitable breathers as may be required for waste system installations. The installation may also acts as a backflow prevention device which ensures the movement of accumulated and temporarily stored effluent and sewage cannot be discharged back to the user facility.

It will be appreciated by persons skilled in the art that numerous variations and/or modifications may be made to the invention as shown in the specific embodiments without departing from the scope of the invention as broadly described. The present embodiments are, therefore, to be considered in all respects as illustrative and not restrictive.

The invention claimed is:

1. An installation for the intermediate holding and storage of liquid, said installation comprising:

a sealable housing having an inlet for receiving said liquid and an outlet drain pipe for discharging said liquid, the housing including a front wall and having a height and a width, the outlet drain pipe extending horizontally through a lower opening in the front wall and the outlet drain pipe having a diameter less than the width and height of the housing, a holding reservoir pivotally mounted on pivot axis within said housing to receive and temporarily store a quantity of said liquid, wherein said holding reservoir is formed as an asymmetrically shaped open bucket adapted to automatically pivot around said axis from a first position adapted for receiving and storing said liquid to a second inverted position where the stored liquid is emptied from a front edge of said bucket into said housing under the influence of gravity once accumulated liquid reaches a sufficient mass, the bucket having a width greater than the diameter of the outlet drain pipe and the bucket having a centroid of plane area and mass moment of inertia to an opposite side of said pivot axis in relation to said front edge, when unladen, and which mass moment of inertia progressively moves during filling from said opposite side toward said front edge to cause the bucket to rotate from the first position to the second inverted position, said bucket pivoting for an angle greater than 45 degrees between the first position and the second inverted position, said housing includes a gradual and continuously tapered and inclined race incorporated into a floor of said housing and extending gradually and continuously from a position below said pivot axis to said outlet drain pipe to divert said liquid directly to said outlet drain pipe, wherein said race has side walls that taper in a side to side direction from an inlet of the race to an outlet of the race so that the distance between the side walls reduces toward the outlet of the race, and the race is inclined toward said outlet drain pipe, and said bucket has a front edge which is positioned sufficiently close to said front wall when moved to said second position so that water exiting said front edge of said bucket hits the front wall of the housing so as to cause a two part flow of waste formed by solid material and waste liquid utilizing the housing to concentrate a velocity applied to the waste liquid, with most of the solid material exiting to said outlet drain pipe in a first flow action which, because of the relative dimensions of the front wall, the bucket and the outlet drain pipe, and the water hitting the front wall of the housing in turn forces a portion of the waste liquid up the inclined race, away from the outlet drain pipe to a position below the bucket, and into contact with the housing whereby the waste liquid is returned towards the outlet drain pipe by gravitational force and most waste liquid exiting to said outlet drain pipe as a second flow action; and wherein said holding reservoir is pivotally mounted remote from and apart from said race so as to provide an uninterrupted fluid flow for the first and second flow action of said waste.

2. An installation according to claim 1, wherein said waste liquid includes sewage and effluent.

3. An installation according to claim 1, wherein said open bucket is biased to automatically return to said first position once emptied.

4. An installation according to claim 1, wherein said bucket shape in cross-section includes a circle portion and a tapered spout extending therefrom.

5. An installation according to claim 4, wherein said spout includes a contoured lip to divert said effluent toward said race.

6. An installation according to claim 1, wherein said reservoir includes a smoothly contoured interior.

7. An installation according to claim 1, wherein said reservoir is pivoted about a set of open bearings and provided with a stop to limit pivotal movement from said first to said second positions to one direction only.

8. An installation according to claim 1, wherein said reservoir includes two counterweights including a first position counterweight positioned at a farthest distance from the pivot point thereof as measured in a horizontal direction when the bucket is in the first position and a second position counterweight positioned at a farthest distance from the pivot point thereof as measured in a horizontal direction in a second direction of the bucket when the bucket is in the second position.

9. An installation according to claim 1, wherein said housing includes an inspection opening and an integral lid therefor wherein said lid includes a support bracket and pivot point for said reservoir.

10. An installation according to claim 1, wherein said installation is incorporated in a sewerage system.

11. An installation according to claim 1, wherein said installation is incorporated in a sanitary water disposal system.

12. An installation according to claim 1, wherein said installation is incorporated in a liquid dosing system.

13. An installation for the intermediate holding and storage of liquid, said installation comprising:

a sealable housing having an inlet for receiving said liquid and an outlet drain pipe for discharging said liquid, the housing including a front wall and having a height and a width, the outlet drain pipe extending horizontally through a lower opening in the front wall and the outlet drain pipe having a diameter less than the width and height of the housing, a holding reservoir pivotally mounted on pivot axis within said housing to receive and temporarily store a quantity of said liquid, wherein said holding reservoir is formed as an asymmetrically shaped open bucket adapted to automatically pivot around said axis from a first position adapted for receiving and storing said liquid to a second inverted position where the stored liquid is emptied from a front edge of said bucket into said housing under the influence of gravity once accumulated liquid reaches a sufficient mass, the bucket having a width greater than the diameter of the outlet drain pipe and the bucket having a centroid of plane area and mass moment of inertia to an opposite side of said pivot axis in relation to said front edge, when unladen, and which mass moment of inertia progressively moves during filling from said opposite side toward said front edge to cause the bucket to rotate from the first position to the second inverted position, said bucket pivoting for an angle greater than 45 degrees between the first position and the second inverted position, said housing includes a gradual and continuously tapered and inclined race incorporated into a floor of said housing and extending gradually and continuously from a position below said pivot axis to said outlet drain pipe to divert said liquid directly to said outlet drain pipe, wherein said race has side walls that taper in a side to side direction from an inlet of the race to an outlet of the race so that the distance between the side walls reduces toward the outlet of the race, and the race is inclined toward said outlet drain pipe, and said bucket has a front edge which is positioned sufficiently close to said front wall when moved to said second position so that water exiting said front edge of said bucket hits the front wall of the housing so as to cause a two part flow of waste formed by solid material and waste liquid utilizing the housing to concentrate a velocity applied to the waste liquid, with most of the solid material exiting to said outlet drain pipe in a first flow action which, because of the relative dimensions of the front wall, the bucket and the outlet drain pipe, and the water hitting the front wall of the housing in turn forces a portion of the waste liquid up the inclined race, away from the outlet drain pipe to a position below the bucket, and into contact with the housing whereby the waste liquid is returned towards the outlet drain pipe by gravitational force and most waste liquid exiting to said outlet drain pipe as a second flow action; and wherein said holding reservoir is pivotally mounted remote from and apart from said race so as to provide an uninterrupted fluid flow for the first and second flow action of said waste;

wherein said housing includes an inspection opening and an integral lid therefor, and wherein said housing includes a support bracket and pivot point for said reservoir.

* * * * *